United States Patent [19]

Hatzold

[11] 4,410,797

[45] Oct. 18, 1983

[54] CALCULATION TABLE FOR FAMILY PLANNING

[76] Inventor: Otfried Hatzold, Turfstrasse 3, D-8000 München 81, Fed. Rep. of Germany

[21] Appl. No.: 213,757

[22] Filed: Dec. 5, 1980

[30] Foreign Application Priority Data

Dec. 6, 1979 [DE] Fed. Rep. of Germany ..... 2949087

[51] Int. Cl.[3] ..... G06C 27/00

[52] U.S. Cl. ..... 235/69; 235/85 FC

[58] Field of Search ..... 235/69, 70 R, 85 R, 235/85 FC, 89 R, 89 A, 79.5, 70 A

[56] References Cited

U.S. PATENT DOCUMENTS

| | | | |
|---|---|---|---|
| 1,892,634 | 12/1932 | Rubinsky | 235/69 |
| 2,034,027 | 3/1936 | Decary et al. | 235/79.5 X |
| 3,486,691 | 12/1969 | Rodriguez | 235/88 RC |
| 3,719,806 | 3/1973 | Davidson | 235/70 R X |

*Primary Examiner*—Benjamin R. Fuller

*Attorney, Agent, or Firm*—Pollock, Vande Sande & Priddy

[57] ABSTRACT

A calculation device for family planning, particulary for pre-planning the sex of a child. The device has a guide plate having a number of parallel guides arranged one above the other, and a cover plate which permits viewing of the guides. A number of slides for insertion into the guides are divided into sufficient divisions to accommodate the days of at least two successive months. An additional guide has a reference point and a window in the cover plate at a distance of fifteen such daily divisions from the reference point in the decreasing direction of the daily sequence. Two marker slides extend transversely over the guides and are slidable on the guide plate and cover plate assembly. The lower marker slide with reference to the daily sequence has two windows separated by two daily divisions and each being the width of one daily division. The upper marker slide has one window the width of one daily division. Recordal of the menstrual cycle on the device permits prediction of those times in a month when conception is likely to result in a female or alternatively a male child.

7 Claims, 1 Drawing Figure

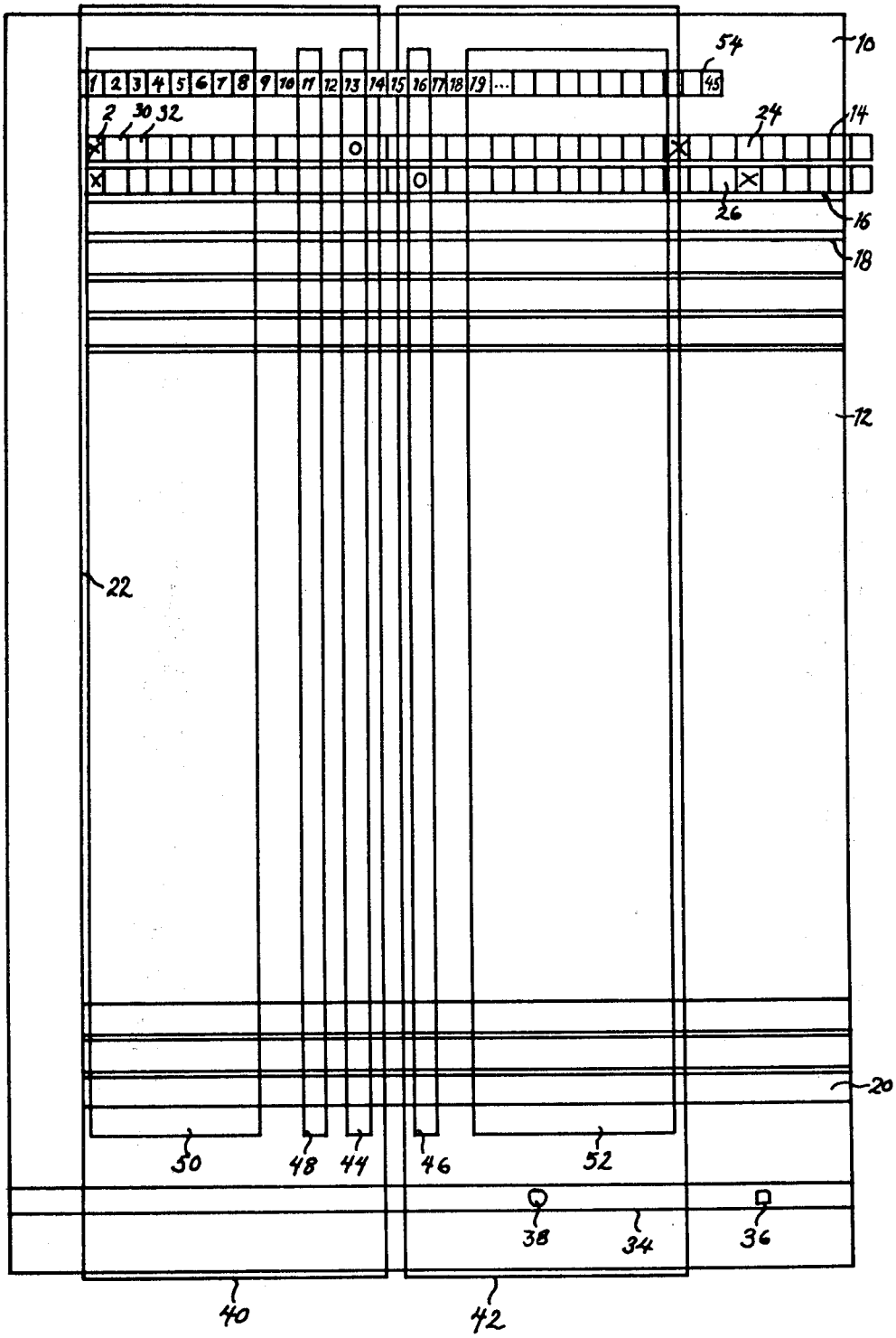
10
54
1 2 3 4 5 6 7 8 9 10 11 12 13 14 15 16 17 18 19 ... 45
2
30
32
24
14
26
16
18
12
22
20
50
48
44
46
52
38
34
36
40
42

CALCULATION TABLE FOR FAMILY PLANNING

This invention relates to a calculation table for family planning, having a guide plate with a plurality of parallel guides, in each of which a sliding element marked with divisions for the consecutive days of at least two months is longitudinally displaceable, and having a cover plate mounted on the guide plate and provided with windows above the sliding elements.

Such calculation table is known from German Utility Model Registration No. 78 34 429. The known calculation table is based on the assumption that the probability of conceiving a female child is greatest two days before ovulation, whereas that of conceiving a male child is greatest one day after ovulation. This conclusion has been reached from the finding that male-producing sperm travels to the ovum more quickly than female-producing sperm, but that female-producing sperm remains capable of fertilization longer, and specifically for about two days. Accordingly, if intercourse takes place two days before ovulation, it is probable that the longer-living, female-producing sperm will meet the ovum while still in fertilizable condition, whereas at this time the male-producing sperm is no longer fertilizable. By contrast, if intercourse takes place one day after ovulation, the quicker male-producing sperm reaches the ovum faster, the ovum remaining fertilizable only for about one day. On the remaining days around ovulation, chance determines the sex of the child.

In spite of this knowledge, reliable planning of the sex of a child is difficult, since the day of ovulation cannot be reliably determined ahead of time. This is particularly true in the case of cycles of irregular length.

The calculation table of the above-named German utility model provides a certain amount of assistance because it makes it possible to record the dates of the beginnings of two successive menstrual periods and the ovulation date therebetween and, by movement of the slider, to make a simple determination of the range of variations of the length of the menstrual cycle and of the date of ovulation. The values so obtained can be used as typical for the woman for the future. By means of lines or markings for ovulation and the conception probabilities for male or female children, the calculation table with new sliders can be made useful for future prediction. The known calculation table therefore certainly represents a useful aid, but requires considerable attentiveness on the part of the user, because she must by herself determine the ovulation region by a series of computations and preparations of lines and markings.

The invention therefore has the object of providing a calculation table of the above-mentioned type which, without any calculation, provides an overview of the days on which conception is and is not likely to take place, the period of time for ovulation and the conception probabilities for girls or boys, and merely involves manual manipulation by the user without requiring continuing computations.

This object is fulfilled in accordance with the invention by a calculation table of the above-mentioned type in that the guides are provided with a stop extending along a line perpendicular to the guides on the side of the descending sequence of days, that the sliding elements are severable between the divisions, that an additional marking guide is provided above which the cover plate has a marking window at a distance of fifteen daily divisions from a reference point arranged in an ascending sequence of days, and that two strip-form marker slides are slidably arranged above the assembly comprising the guide plate and cover plate, perpendicularly to the guides, the marker slide on the downward side with reference to the sequence of daily divisions having two windows separated by two daily divisions extending transversely to the guides, and the marker slide on the upward side having one window extending perpendicularly to the guides, each of the windows having the width of one daily division.

This calculation device is based on the realization that, despite the differences in menstural cycles, ovulation in all women is extraordinarily regular and takes place fifteen days before the succeeding menstrual period begins. As soon as the first day of the menstrual period is ascertained, the day of the previous ovulation can be determined with great certainty. The marking guide, into which each slider can be inserted, is provided for this purpose. After the first day of the period has been marked on the slider, this mark is brought into alignment with the above mentioned reference point, and the day of ovulation is marked with a pencil or the like through the window which is positioned at a distance of fifteen daily divisions in the decreasing direction of the daily sequence.

Since each slider is divided into daily divisions for at least two successive months, it is possible to mark on each slider the beginnings of two successive periods and, with the aid of the marking guide, to determine the day of ovulation lying between these.

For even greater convenience, it is not necessary, in contrast to the German utility model, to bring the beginnings of the first periods on each slider into alignment over the whole table by displacing the sliders in the guides. Rather, the sliders consist of material which is severable, rippable or cuttable in the regions between the daily divisions, e.g., cardboard having lines of perforations or the like between the divisions, so that the sliders can be severed immediately before the daily division representing the first recorded menstrual period. As the guides have a stop extending in a line across all the guides, alignment of all the dividers marked in the course of time results automatically, the first days of the mentrual period on each slider being arranged in a line perpendicular to the guides.

After a number of sliders have been marked and positioned in the manner described, the ovulation days do not lie in a line perpendicular to the guides on account of the usually irregular cycle lengths, but rather in a region which can extend over the width of several daily divisions.

Two strip-shaped marker slides extending perpendicularly to the guides are provided on the calculation table. To simplify the description which follows, it will be assumed that the guides extend horizontally and that the sliders have daily divisions which increase from left to right, and that the marker slides extend vertically. It will be understood, however, that the guides and correspondingly the marker slides may extend in any desired direction.

The left marker slide, or the one on the diminishing side of the daily sequence, has a right hand window which extends perpendicularly over the guides and has the width of one daily division, and which is aligned with the earliest ovulation day. The right hand marker slide has only one narrow window which is aligned with the latest ovulation day shown on the calculation table. Thus, extending between the two windows of the marker slides is the region of the days of ovulation which have already occurred and which therefore will probably occur in the future.

The left marker slide has a further window positioned two daily divisions to the left of the narrow window already mentioned, and having the width of one daily division, showing the days on the sliders that lie two days before the earliest possible ovulation date and therefore indicating the likelihood of conceiving a female child. The right-hand marker slide has only one narrow window, which shows at the same time the latest ovulation day as well as those days on which there is a likelihood of conceiving a male child.

On the left marker slide at a spacing of three daily divisions, there is a broad window, e.g., extending over twelve daily divisions, which shows conception-free days. A corresponding window is located on the right hand marker slide at a distance of three daily divisions to the right of the narrow window, having a width of, e.g., fourteen daily divisions.

If the cover plate and marker slides are made of opaque material, the windows referred to above are cut out of said material. If transparent material is used, the windows on the marker slide need not be cut out, but instead it is sufficient that they be marked out by frames, transparent colored imprints or the like.

A preferred embodiment of the invention will now be described in detail with reference to the attached drawing, which shows a plan view in schematically represented calculation table.

The calculation table, in the embodiment shown, comprises a rectangular guide plate 10 made of cardboard, plastic or the like. A cover plate 12, not shown in detail in the drawing, is positioned on the guide plate 10, and is preferably united with the guide plate, e.g., by glueing. A plurality of parallel and horizontal (in the embodiment shown) guides 14, 16, 18, 20 lying one below the other are located on the guide plate, these being shown only in part in the drawing. As an example, twenty-four guides are provided for the months of two years. The guides can be formed by the cover plate having raised parts in the regions of the guides, and consequently the cover plate may be formed, for example, as a deep drawn, if desired transparent, plastic foil. All the guides 14, 16, 18, 20 have at their left hand ends a stop 22 extending in a line perpendicular to all of the guides, so that slides 24, 26 can be pushed from the right hand side in the guides up to this stop.

The slides 24, 26, which are used in conjunction with the guide plate, are subdivided into single day divisions 28, 30, 32, and show in these divisions the dates of the successive days of two consecutive months of a specified year. In the embodiment shown, it is assumed that the days are arranged in sequence from left to right. The month appearing at the right hand side of a slide is repeated in each case on the left hand side of another slide. Each guide and each slide consequently serves only for the analysis of one cycle of the user.

When the calculation table is utilized, the first day of the first menstrual bleeding to occur is marked in the left hand month of an appropriate slide, as indicated by the cross in the division 28. Then the first day of the next menstrual bleeding is marked by the cross appearing to the right on the slide 24. The slide 24 is then introduced into a marking guide 34, which is provided on the guide plate outside the region of the other guides. The marking guide 34 has, in the embodiment shown, a rectangular marking 36 and, at a distance to the left of this corresponding to fifteen daily divisions, a window 38 which penetrates the cover plate 12. The user aligns the right hand cross on slide 24 with mark 36 and then draws a circle, as shown on the slide 24, in the window 38 on the slide. Since ovulation regularly takes place fifteen days before the beginning of the next menstrual bleeding, the circle indicates the day of ovulation.

Next the slide is separated or severed on the left from the left cross and is inserted into guide 14 as far as the stop 22.

The next slide 26 is dealt with correspondingly, it being noted that, in that particular case, the cycle was three days longer, so that the circle which indicates ovulation has also been moved three daily divisions to the right.

If several months are monitored in this manner, a distribution of ovulations over several daily divisions is obtained, permitting the assumption that ovulations will remain within this distribution in the future, with reference to the beginning of the preceding menstrual bleeding.

Two marker slides 40 and 42 are slidable transversely to the arrangement of the guide plate and cover plate, i.e., parallel to the longitudinal direction of the guides, and these extend in the form of strips perpendicular to the guides. The marker slide 40 shown on the left has a narrow window 44 extending along its right hand edge, the window having the width of one daily division. At the facing left hand edge of the right hand marker slide 42, there is a correspondingly formed and dimensioned window 46. The windows 44, 46 extend over the entire guides 14, 16, 18, 20. If the marker slides 40, 42 are made of transparent material, the windows 344, 46 need not be cut out of the material, but may be marked merely by frames, transparent colored imprints or the like. The marker slides 40, 42 are so adjusted that the windows 44, 46 are located over the leftmost and respectively the rightmost of the ovulation days of the months being observed. It can thus be assumed therefrom that future ovulations will also be within the region defined by the windows 44, 46. There is thus the possibility of predicting the ovulation region with high probability for a newly inserted slide on which solely the left hand cross for the beginning of the cycle has been marked.

On the assumption that two days before ovulation there is a high probability for conception of a female child, it follows that the conception of a male child can be ruled out on only one day, which is two days before the earliest possible ovulation, and that, on this day, there is a high probability of conceiving a female child or of failure of conception.

For this reason, a further window 48 is provided in the left marker slide 40 at a distance of two daily divisions to the left of the window 44, the further window also having the width of one daily division and extending over all the guides. This window 48 can, for example, be symbolized for a female child by a pink colored stripe.

On the other hand, on the latest day that ovulation can take place, the conception of a male child can be expected with high probability and the conception of a female child can be prevented. These days appear simultaneously in the window 46 which also shows the latest ascertained ovulation days.

Two further windows 50 and 52 extend over a whole series of daily divisions parallel to the above-mentioned windows 44, 46, 48 at a diatance of three daily divisions on the left or the right of the windows 48, 46. These windows 50, 52 show those days on which there is no possibility of conception. How many days may be shown in the windows 50, 52 for the determination of conception-free days depends on the duration of the cycle. However, in every case the border line facing the ovulation region is important, i.e., the right line of window 50 and the left line of window 52.

In the foregoing descripition reference to a distance of two daily divisions, three daily divisions, etc. does not refer to the number of free intermediate divisions, but rather the numerical difference between the dates within the daily divisions. For example, in this terminology, November 12 lies at a distance of one daily division from November 13 and two daily divisions from November 14.

In the embodiment described, a numeral strip 54 is located above the guides 14, 16, 18, 20 and parallel to these, and is divided into single daily divisions corresponding to the slides 24, 26 and contains the numerals 1 to 45 in ascending order. This numeral strip permits immediate determination of the duration of the cycle without the conversion of the calendar date to single days.

The calculation table according to the invention can thus be used in the same way both for choosing the sex of a child and for contraception.

I claim:

1. A calculation table for family planning comprising (a) a guide plate;

(b) a plurality of parallel guides on said guide plate;

(c) a slide longitudinally slidable in each of said guides and bearing divisions for a sequence of days for at least two consecutive months, said slides being severable between said divisions;

(d) a cover plate attached to said guide plate and having windows above said slides;

(e) stop means on each of said guides extending in a line perpendicular to said guides on the descending side of said sequence of days;

(f) a marking guide on said guide plate outside the area of said other guides, comprising a marking and, at a distance corresponding to fifteen daily divisions in ascending sequence, a window which penetrates said cover plate (g) two strip-shaped marker slides extending perpendicularly to said parallel guides and slidably arranged above said guide plate and cover plate arrangement;

(h) the marker slide on the downward side with reference to said daily sequence of said slides being provided with two windows separated by two daily divisions and extending transversely over said parallel guides and the marker slide on the upward side having a window of the width of one daily division extending transversely over said guides.

2. A calculation table according to claim 1, wherein said cover plate is made entirely of transparent material.

3. A calculation table according to claim 1, wherein said guide plate material is selected from the group consisting of cardboard, paste-board and plastic.

4. A calculation device according to claim 1, wherein said slides are made of material selected from the group consisting of cardboard, paste-board and plastic.

5. A calculation device according to claim 1, wherein said marker slide which is downward with respect to said sequence of days has a further window provided at a distance of three daily divisions downwards from the downward window having a width of several daily divisions, the window extending transversely over said guides.

6. A calculation table according to claim 1, wherein said marker slide on the upward side with respect to said sequence of days has a window positioned three daily divisions upwardly with respect to said sequence of days from said window and having a width of several daily divisions, said additional window extending transversely to said guides.

7. A calculation table according to claim 1, wherein twenty four guides are provided on said guide plate.

* * * * *